US005716750A

United States Patent [19]

Tyagi et al.

[11] Patent Number: 5,716,750

[45] Date of Patent: Feb. 10, 1998

[54] METHOD AND APPARATUS FOR CONTROLLING GLOSS FOR TONER IMAGES

[75] Inventors: Dinesh Tyagi, Fairport; Muhammed Aslam; Donna Anne DiPrima, both of Rochester; Robert Edward Zeman, Webster, all of N.Y.

[73] Assignee: Eastman Kodak Company, Rochester, N.Y.

[21] Appl. No.: 672,895

[22] Filed: Jun. 28, 1996

[51] Int. Cl.[6] ..... G03G 13/20

[52] U.S. Cl. ..... 430/124; 399/320; 427/545

[58] Field of Search ..... 430/124; 399/320; 427/545

[56] References Cited

U.S. PATENT DOCUMENTS

| | | | |
|---|---|---|---|
| 3,903,320 | 9/1975 | Erhardt et al. | 430/98 |
| 4,258,095 | 3/1981 | Larson et al. | 428/172 |
| 4,639,405 | 1/1987 | Franke | 430/124 |
| 4,828,950 | 5/1989 | Crandall | 430/45 |
| 4,913,991 | 4/1990 | Chiba et al. | 430/45 |
| 5,019,869 | 5/1991 | Patton | 355/290 |
| 5,085,962 | 2/1992 | Aslam et al. | 430/99 |
| 5,118,589 | 6/1992 | Aslam et al. | 430/124 |
| 5,162,860 | 11/1992 | Nami et al. | 355/327 |
| 5,234,783 | 8/1993 | Ng | 430/45 |
| 5,256,507 | 10/1993 | Aslam et al. | 430/42 |
| 5,258,256 | 11/1993 | Aslam et al. | 430/124 |
| 5,319,429 | 6/1994 | Fukuchi et al. | 355/290 |
| 5,334,471 | 8/1994 | Sacripante et al. | 430/106.6 |
| 5,395,723 | 3/1995 | Mahabadi et al. | 430/109 |

FOREIGN PATENT DOCUMENTS

| | | | |
|---|---|---|---|
| 133422 | 5/1987 | Japan | G03G 15/01 |
| 2-333829 | 11/1990 | Japan | G03G 15/01 |

*Primary Examiner*—Mark Chapman
*Attorney, Agent, or Firm*—Doreen M. Wells

[57] ABSTRACT

This invention provides a method and an apparatus of imparting various gloss levels to toner images. The method comprises the steps of:

fixing toner to a receiver in a fixing system, wherein said fixed toner possesses residual stress; and post-treating said fixed toner to at least partially relax said residual stress of said fixed toner.

This invention also provides a fixing apparatus comprising:

a fixing system for fixing toner to a receiver wherein said fixed toner possesses residual stress; and a post-treatment element capable of at least partially relaxing said residual stress of said fixed toner.

20 Claims, 2 Drawing Sheets

METHOD AND APPARATUS FOR CONTROLLING GLOSS FOR TONER IMAGES

FIELD OF INVENTION

This invention relates to a method of and apparatus for fixing toner particles to a receiver in an electrostatographic apparatus. More particularly, this invention relates to a method of and apparatus for fixing toner particles to a receiver to provide a fixed toner image having a desired gloss.

BACKGROUND OF THE INVENTION

In electrostatography, an image comprising a pattern of electrostatic potential (also referred to as an electrostatic latent image), is formed on a surface of an electrostatographic element and is then developed into a toner image by contacting the latent image with a dry electrographic toner made up of toner particles to form a toner image. Typically, the toner image is then transferred from the electrostatographic element to a receiver to which it is fused by heat and pressure.

The desired gloss of fused electrostatographic images varies. Typically, it is preferred that multicolor pictorial images have a glossy finish and monochromatic text and graphics have a matte finish.

Several methods for imparting glossy or matte finishes to an image have been disclosed. One method is to cover a multicolor toner image with clear, glossy toner. The clear toner can be laid down in an image configuration or it can be laid down uniformly over the whole image. See, for example, Crandall, U.S. Pat. No. 4,828,950 and Ng, U.S. Pat. No. 5,234,783.

Another method to provide glossy pictorial toner images, produced in an undercolor removal apparatus, is to lay a black matte toner down first and completely cover it by the glossier color (cyan, magenta, yellow) toners. Examples of such methods are described in Japanese Patent Application 133422/87, Laid Open No. 300254/88, Dec. 7, 1988. Additional references which disclose the use of glossy and matte toner combinations include Japanese Patent Application 90JP-333829, Laid Open No. C92-132261, and U.S. Pat. Nos. 5,162,860 and 5,256,507.

The use of different fuser rollers or finishing apparatus to effect the gloss of a fused toner image has been widely practiced and disclosed. It has been disclosed that hard metallic rollers covered with a fluorocarbon resin can be used to produce fused toner, images having high gloss. On the other hand, most soft rubber coated rollers impart a matte finish to the fused images.

Aslam et at, U.S. Pat. No. 5,118,589 discloses the use of pressure members with a predefined surface to impart either gloss or texture to a heat softenable layer of a receiver onto which color toner particles have been thermally transferred. The use of textured pressure members to impart texture to fixed toner images has also been disclosed in U.S. Pat. Nos. 4,258,095 and 5,085,962. U.S. Pat. No. 5,019,869 discloses an electrophotographic device in which a finish is applied to a toner image by selecting one of a plurality of finishing rollers, each roller having a different and distinct surface texture. Further, U.S. Pat. No. 5,319,429 illustrates the use of a fusing apparatus comprising two endless belts each having a glossy surface to provide glossy images.

U.S. Pat. No. 4,639,405 discloses an apparatus for providing glossy fused toner images which passes toner-bearing receivers sequentially through a first and second pair of rollers, the first pair of rollers fuses the toner, the second pair of rollers provides gloss to the toner image.

Another method for affecting the gloss of an electrophotographic image is to change the rheology, and therefore, the melt flow characteristics of the toner composition. A toner which has higher melt flow properties at a given temperature, provides higher image gloss as compared to a toner formulation which has lower melt flow properties. Because the melt viscosity of a polymer changes as a function of the weight average molecular weight, substantial changes in the melt viscosity of a toner can be achieved by controlling the molecular weight of the toner binder. References which disclose that changing the molecular weight can affect the gloss include U.S. Pat. Nos. 4,913,991 and 5,258,256.

The amount of crosslinking in the polymer binders of toners also affects the gloss. Typically, toners having high crosslinked polymer binders provide matte images. An example of such toner for the purpose of providing a low gloss image is detailed in U.S. Pat. No. 5,395,723.

U.S. Pat. No. 5,334,471 teaches the method of controlling the gloss in an electrophotographic toner image by utilizing light-scattering particles of a specific size range. The light-scattering particles are large enough to provide a bumpy image surface which imparts low gloss.

As described above, in electrostatographic processes using dry toners, matte or glossy finishes of the fused toner image can be provided either by controlling the rheological behavior of the toner or by controlling the surface texture of the fusing members. With these methods when using a single fixing apparatus, it is not convenient to provide controllable or differential gloss levels in a fused toner image. Controllable gloss levels are desired, for example, when consecutive toner images should have different gloss levels, and differential gloss levels are desired, for example, when a multicolor pictorial image has text and graphics.

Therefore, there exists a need for a method and apparatus for producing toner images having varied gloss either within a toner image or in consecutively formed and fused toner images without changing either the toner composition or the fuser member in the fusing apparatus.

SUMMARY OF THE INVENTION

This invention provides a method and an apparatus of imparting various gloss levels to toner images. The method comprises the steps of:

- fixing toner to a receiver in a fixing system, wherein said fixed toner possesses residual stress; and
- post-treating said fixed toner to at least partially relax said residual stress of said fixed toner.

This invention also provides a fixing apparatus comprising:

- a fixing system for fixing toner to a receiver wherein said fixed toner possesses residual stress; and a post-treatment element capable of at least partially relaxing said residual stress of said fixed toner.

The advantages of this invention are that it provides a method and apparatus for producing toner images fixed to a receiver having various gloss levels either within a single fixed toner image or in consecutively formed and fixed toner images when using the same toners and the same fixing apparatus for producing all the fixed toner images. The toners can be formulated or the post-treatment designed to provide glossy toner areas, for example pictorial images, and matte toner areas, for example text, in a single toner image.

DETAILED DESCRIPTION OF THE INVENTION

Figure 1:
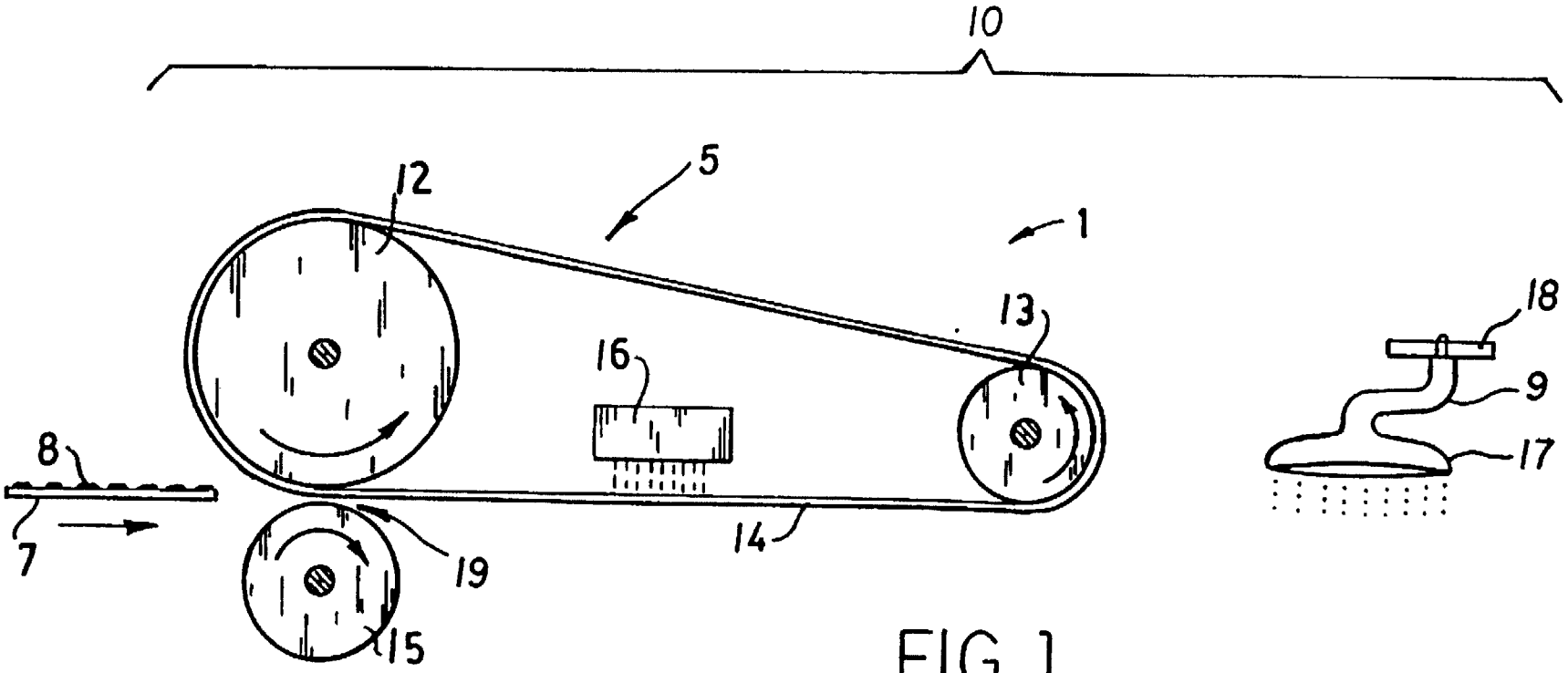
FIG. 1 is a schematic illustration of an apparatus of this invention suitable for carrying out the method of this invention.

Toners generally consist of about 60 to 95 percent by weight toner binders. All toner binders comprise polymeric materials, and all polymeric materials exhibit a "memory" behavior when they are deformed in a manner that maintains residual stress in the polymeric materials. (The other components of the toners, including pigments, charge agents, release agents, and other addenda do not generally effect the residual stress of the binder polymer.) The "memory" is due to the long molecular chain architecture of the binder polymer. The "memory" allows the polymer having residual stress to return to its original form. For example, if a round polymer is flattened and maintains residual stress, then if a stress releasing or relaxing event occurs, the particle will try to regain some or all of its original round shape. On the other hand, if a polymer is deformed leaving no residual stress, then it will not possess any "memory", and it is permanently deformed. The specific characteristic of the binder polymer which determines if the polymer will undergo "memory" effect is its characteristic relaxation time. If a polymer has been deformed for a duration which is less than its characteristic relaxation time and the polymer is kept below its glass transition temperature (Tg), or the polymer is deformed for a duration which is less than its characteristic relaxation time and the polymer is quenched to a temperature below its Tg, then it will have residual stress. On the other hand, if a polymer has been deformed for a duration which is longer than its characteristic relaxation time, then it will not have residual stress. The relationship between the polymer molecular weight, molecular architecture, characteristic relaxation time, chemical nature of the polymer backbone and temperature, etc. are known or can be determined by those who are knowledgeable in the field of polymer science. For example, the interdependence and relationships between the characteristic relaxation time, temperature, molecular architecture and the extent of deformation are described in *Viscoelastic Properties of Polymers*, by J. D. Ferry, 3rd Ed., John Wiley & Sons, Inc., New York (1980), incorporated herein by reference.

Table 1 illustrates the relaxation times for various polymers at 100° C., particularly illustrating the effect of composition and molecular weight on the relaxation times. The polymers in Table 1 are indicated by their trade names and the companies that manufacture them, except the ones made by Eastman Kodak Co. which were made according to the process described by U.S. Pat. No. 4,912,009. Table 2 illustrates the effect of temperature on the relaxation times for various polymer blends. In Table 2, Polymer Blend A was prepared by melt-blending 60% by weight of PLIOTONE 2003 from Goodyear Tire & Rubber Co. and 40% by weight of PICCOTEX 100 from Hercules Sanyo Inc. Polymer Blend B was prepared by melt-blending 80% by weight of PLIOTONE 2015 from Goodyear Tire & Rubber Co. and 20% by weight of PICCOTEX 100 from Hercules Sanyo Inc. Polymer Blend C was prepared by melt-blending 60% by weight of PLIOTONE 2015, and 40% by weight of PICCOTEX 100. The relaxation times were measured as described in U.S. Pat. No. 4,806,635, incorporated herein by reference.

TABLE 1

Relaxation Times for Various Polymers at 100° C.

| Polymer | Manufacturer | Tg (°C.) | Wt. Avg. MW | Relaxation Time (sec.) |
|---|---|---|---|---|
| PLIOTONE 2003 | Goodyear Tire & Rubber | 57 | 140,000 | 36.56 |
| PLIOTONE 2015 | Goodyear Tire & Rubber | 57 | 73,000 | 10.60 |
| PLIOLITE S5E | Goodyear Tire & Rubber | 52 | 56,000 | 0.25 |
| PLIOLITE S5D | Goodyear Tire & Rubber | 52 | 71,000 | 6.57 |
| PLIOLITE AC-80 | Goodyear Tire & Rubber | 50 | 73,000 | 3.10 |
| PLIOLITE VTL | Goodyear Tire & Rubber | 52 | 78,000 | 6.57 |
| PLIOLITE VTAC-L | Goodyear Tire & Rubber | 55 | 83,000 | 1.00 |
| PICCOTONER 1278 | Hercules-Sanyo Inc. | 62 | 92,000 | 26.63 |
| PICCOTONER 1292 | Hercules-Sanyo Inc. | 56 | 70,000 | 3.73 |
| PICCOTONER 1221 | Hercules-Sanyo Inc. | 62 | 48,000 | 1.86 |
| PICCOTEX 100 | Hercules-Sanyo Inc. | 50 | 1,800 | 0.00005 |
| PICCOTEX 120 | Hercules-Sanyo Inc. | 68 | 3,800 | 1.08 |
| Styrene-butyl acrylate | Eastman Kodak Co. | 52 | 172,000 | 3.73 |
| Styrene-butyl acrylate | Eastman Kodak Co. | 52 | 102,000 | 0.62 |
| Styrene-butyl acrylate | Eastman Kodak Co. | 52 | 76,000 | 0.089 |
| Styrene-butyl acrylate | Eastman Kodak Co. | 52 | 64,000 | 0.027 |
| Styrene-butyl acrylate | Eastman Kodak Co. | 52 | 56,000 | 0.0023 |
| Polystyrene | Eastman Kodak Co. | 50 | 7,000 | 0.00093 |

TABLE 2

Relaxation Times for Various Polymer Blends at Different Temperatures

| Temperature °F. | Polymer Blend A | Polymer Blend B | Polymer Blend C |
|---|---|---|---|
| 180 | 7.62 | 3.61 | 2.53 |
| 190 | 3.76 | 1.71 | 1.19 |
| 200 | 1.93 | 0.847 | 0.594 |
| 210 | 1.03 | 0.438 | 0.307 |
| 220 | 0.573 | 0.234 | 0.164 |
| 230 | 0.327 | 0.129 | 0.091 |

TABLE 2-continued

Relaxation Times for Various Polymer Blends at Different Temperatures

| Temperature °F. | Polymer Blend A | Polymer Blend B | Polymer Blend C |
|---|---|---|---|
| 240 | 0.192 | 0.074 | 0.052 |
| 250 | 0.115 | 0.043 | 0.030 |
| 260 | 0.071 | 0.025 | 0.018 |

The present invention is based on the principle that the polymers in the toner having a characteristic relaxation time longer than the dwell time in a fixing system at the temperature and pressure of the toner in the fixing system will have residual stress. The dwell time in a fixing system is the amount of time that the toner is subjected to heat and/or pressure which causes the plastic deformation of the toner leading to at least some of the fixed toner to have residual stress, and preferably adheres the toner to a receiver. For example, the dwell time for a fixing system consisting of two rollers is the time the toner spends between the two rollers, also referred to as nip time. In addition to the nip time, the amount of residual stress that will remain in a toner after fixing the toner in a fixing system will also depend on several factors which include fixing temperature, fixing pressure, rate of deformation, extent of deformation, and the difference between the characteristic relaxation time and the dwell time of the toner. For example, for a nip time shorter than the characteristic relaxation time of the binder polymer, the amount of residual stress in the fixed toner image can be increased by lowering the fixing temperature, and/or increasing the fixing pressure. The amount of residual stress in a fixed toner is mostly a function of the difference between the characteristic relaxation time of the toner at the fixing temperature and the dwell time in the fixing system.

Once fixed toner images with residual stresses have been obtained, the gloss present in the image will not change as long as the toner is not exposed to a post-treatment which will relieve the residual stress. However, if it is desired to achieve a gloss level which is different from the gloss level of the fixed toner image, the fixed toner image can be post-treated to relax the residual stress in the fixed toner image. Post-treatment steps include chemical, electrical, thermal, and mechanical treatments, or combinations of treatments. The preferred post-treatment step to relieve residual stress is heating the fixed toner image to a temperature above the Tg of the toner. Another preferred post-treatment step to relax the residual stress is to apply a plasticizer to the fixed toner image. These post-treatment steps allow the toners to "bounce back" due to their polymer "memory" and thereby alter the image gloss level. The amount of post-treatment can be varied. Typically the more post-treatment, for example, the more heat that is applied to the fixed toner image, the more the residual stress is relaxed. By varying the amount of post-treatment, the final gloss of the fixed toner image can be varied.

Methods and apparatus of this invention can be designed to either increase or decrease the gloss of a fixed toner image having residual stress. For example, a fixing system consisting of rollers having smooth surfaces can be used to make a fixed toner image having high gloss and residual stress, and heat can be applied to the fixed toner image by a non-contact method, such as by a heat lamp, to cause the gloss level to decrease. On the other hand, a rough fixing member surface can be used to make a fixed toner image having a matte finish and residual stress, and plasticizer can be sprayed onto the fixed toner image to cause the gloss level to increase. In the preferred embodiment, the fixed toner image possesses high gloss and high residual stress which can be relaxed with the post-treatment of the fixed toner image to produce a less glossy finish.

The preferred post-treatment step is heating the fixed toner image to relieve the stress, and can be accomplished by various methods and by various heated post-treatment elements. For example, the fixed toner image can be contacted by heated rollers, heated metal plates, radiant heaters, or the heat from convection heaters, and heated blowers. It is presently preferred that the post-treatment element not contact the toner; therefore, the preferred heated elements are radiant heaters, convection heaters, and metal plates which heat the back, that is, the non-toner-bearing side of the toner-bearing receiver. One of these post-treatment elements is preferably placed in the path of the image after it has passed through the fixing system. One advantage of this embodiment, that is, the application of heat, is that if the results of the post-treatment are not as desired, the fixed toner image can be passed through the fixing system again to put the residual stress back into the fixed toner image and the post-treatment can be repeated if desired.

Another preferred post-treatment step to relax residual stress is to apply a plasticizer to the fixed toner image. A plasticizer is a substance or material incorporated in a material (usually a plastic or an elastomer) to increase its flexibility, workability or extensibility. A plasticizer may reduce the melt viscosity, lower the temperature of a second order transition or lower the elastic modulus of the product. Examples of useful plasticizers include phthalates, adipates, trimellitates, benzoic acid esters, azelates, isobutyrates, glutarate esters, citrate esters, petroleum oils, mineral oils, and phosphate esters. Additional plasticizers can be selected from those described by Sears, J. K. and Darby, J. R. in *The Technology of Plasticizers* (John Wiley & Sons, NY 1982). More specific examples of plasticizers include di-2-ethylhexyl terephthalate, di-2-ethylhexyl phthalate (DOP), dibutyl phthalate (DBP), ditridecylphthalate (DTP), dioctyl terephthalate, butyl benzyl phthalate (BBP), dipropylene glycol dibenzoate, di-n-butyl azelate, di-n-hexyl azelate, di-2-ethylhexyl azelate, 2,2,4-trimethyl-1,3-pentanediol, diisodecyl glutarate, triethyl citrate, triaryl phosphate ester, tricresyl phosphate (TCP), diocty adipate (DOA), and alkyl diaryl phosphates.

Other examples of plasticizers include solvents for the toner binder. Examples of such solvents include ethyl acetate, propyl acetate, dichloromethane (DCM), and many others known to a person of ordinary skill in the art.

The plasticizers are preferably diluted in a non-plasticizing solvent before applying the placticizing solution to the fixed toner image having residual stress. Non-plasticizing solvents do not plasticize the polymer and therefore are not effective in relieving the residual stress. Solvents useful for this purpose include saturated hydrocarbons, alcohols, phenols, glycol ethers, diethyl ether, acetone, and acetic acid. The most preferred non-plastizing solvents are methanol, propanol, and acetone. The plasticizing solutions are typically at a concentration between 0 and 10% by weight of the plasticizer. The higher the concentration, typically the more the residual stress is relaxed per volume of the plasticizer solution applied. However, the same amount of relaxation can usually be achieved by applying a larger volume of a lower concentration plasticizer solution. The plasticizer can be applied to the toner image by any method including spraying, brushing, dipping, and rolling. Certain plasticizers which are available in a solid form can be applied by either dissolving the solid plasticizer in a non-plasticizing solvent or by applying the solid plasticizer to the fixed toner image and afterwards applying a non-plasticizing solvent to the image. In this method, either the solid plasticizer or the solvent or both can be applied in limited areas of the fixed toner image to selectively modify the gloss.

Post-treatment elements useful for the application of plasticizers include spray nozzles, brushes, rollers, and atomizers. The amount of plasticizer applied will depend on the amount and type of toner in the fixed toner image, the type of plasticizer used, and the amount of relaxation of the toner desired, and can be determined by experimentation for the desired final gloss of the fixed toner image. The use of too much plasticizer should be avoided or the fixed toner image may offset from the receiver onto other surfaces.

The amount of relaxation allowed in a fixed toner image having residual stress can be controlled by controlling the amount of the post-treatment step. For example, the temperature of the post-treatment element, and/or the exposure time of the fixed toner image with the post-treatment element, and/or the amount of plasticizer applied to the fixed toner image can be increased or decreased. The areas where relaxation occurs in an image can also be controlled by only exposing limited areas of the toner image to the post-treatment, thereby creating, for example, glossy pictorial portions and matte text portions of a post-treated toner image. For example to make matte text portions and glossy pictorial portions from a glossy fixed toner image having residual stress, heat can be applied to only the text portions of the fixed image, or plasticizer can be sprayed only in the text portions to relieve the residual stress in those areas and thereby decrease the gloss.

In the method of the present invention, toners having different characteristic relaxation times can be used together in multicolor fixed toner images. Images having various gloss levels can be produced using the toners having various relaxation times. For example, a black toner having a characteristic relaxation time substantially longer than the dwell time in the fixing system can be used in the same toner image as color toners (e.g. cyan, magenta, yellow) having characteristic relaxation times less than the dwell time in the fixing system. If the fixing system produces a glossy fixed toner image comprising the cyan, magenta, yellow and black toners, and there is no post-treatment, then the image will remain entirely glossy. On the other hand, if the fixing system produces a glossy fixed toner image comprising the cyan, magenta, yellow and black toners, and the fixed toner image is post-treated by the application of heat at a temperature above the Tg of the toners, then the black toner will become less glossy, and the color toners will remain glossy. The post-treatment application of heat will not change the color toners' gloss, because the color toners do not have residual stress, because their characteristic relaxation times were less than the dwell time in the fixing system.

Once the fixing system and toners are selected so that at least some of the fixed toners have residual stress, unlimited control over the gloss level of toner images can be achieved by adjusting the post-treatment of the fixed toner image. Further, the disclosed method and apparatus of the invention can be tailored to control image gloss in either a simplex mode or a duplex mode.

Preferably, a toner bearing receiver is produced by an electrostatographic image-forming process, including digital four-color printers and electrophotographic machines for use in the method and apparatus of this invention. Electrostatographic imaging processes have been extensively disclosed and are well known to a person of ordinary skill in the art. The toner bearing receiver can comprise line copy, continuous tone images and half-tone images as well as combinations thereof. Preferably the toner-bearing receiver is then passed through a fixing apparatus of this invention. The fixing apparatus comprises a fixing system which fixes the toner to the receiver and a post-treatment element. The operating conditions of the fixing system can be selected so as to cause the plastic deformation of toner which results in at least some of the fixed toner to have residual stress and the fixing system also preferably causes the toner to adhere to a receiver. (The toner may not adhere to the receiver in an embodiment in which a transferable toner image is being made.) The fixing system typically consists of one or more fixing members, such as, rollers, plates, and belts, which are heated or in pressurized contact and preferably are both heated and in pressurized contact. The preferred fixing systems for this invention have been disclosed in previous electrostatographic patents and are typically referred to as roller fusing systems, or belt fusing systems, or plate fusing systems. Roller fusing systems preferably comprise two rollers in pressurized contact. Belt fusing systems preferably comprise a belt in pressurized contact with a roller. Some of these systems are disclosed, for example in U.S. Pat. Nos. 3,539,161; 3,669,706; 3,666,247; 5,023,038; 5,089,363; and 5,258,256, incorporated herein by reference. The preferred fixing systems and post-treatment elements will be described in reference to FIGS. 1 to 3.

FIG. 1 illustrates a fixing apparatus 10 which comprises a fixing system 5 comprising an internally-heated fuser roller also referred to as heating roller 12, a roller 13 spaced from the heating roller 12, an endless belt 14 which is conveyed in a counterclockwise direction upon rotation of the heating roller 12 and roller 13. Pressure roller 15 is biased against the heating roller 12 and the continuous belt 14 is cooled by impinging air provided by blower 16 disposed above belt 14. In operation, receiver 7 beating the unfixed toner image 8 is transported in the direction of the arrow into the nip 19 between heating roller 12 and pressure roller 15 which can be heated if desired. Following fixing of the toner to the receiver in the nip 19, the fixed toner image remains in contact with the belt 14 past the blower 16, which cools the toner. The fixed toner image on the receiver 7 then separates from belt 14 as the belt passes around roller 13. The post-treatment element 9 consists of a spray nozzle 17 and a valve 18 for the application of plasticizer to the fixed toner image. The amount of plasticizer applied to the fixed toner image can be adjusted by opening or closing valve 18 to maintain or change the gloss of the fixed toner on the receiver 7.

Figure 2:
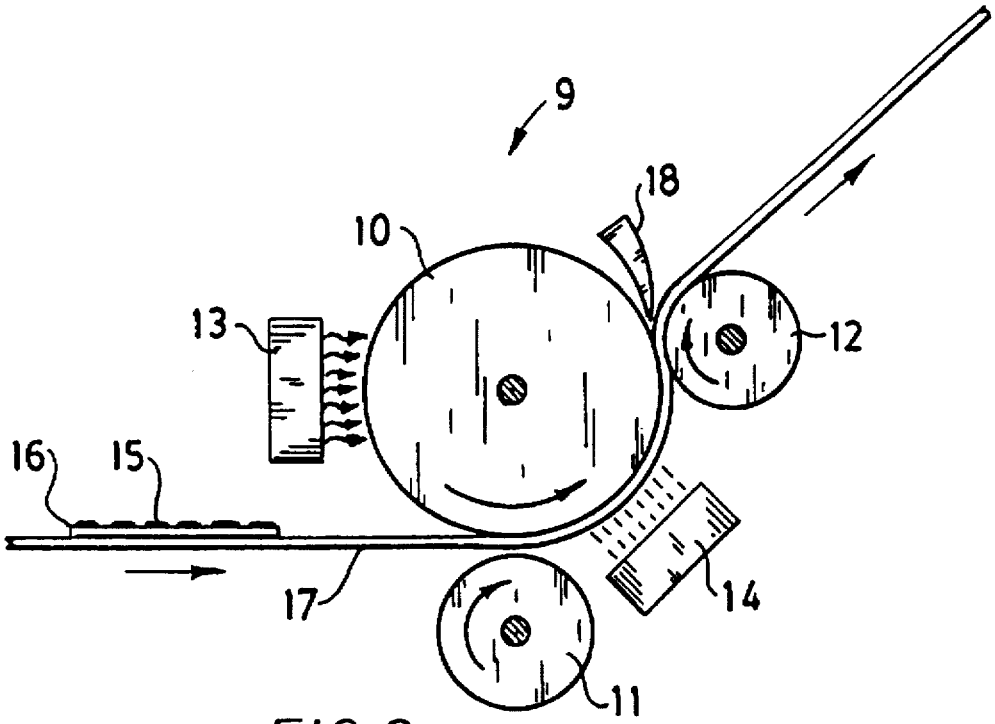
FIG. 2 is a schematic illustration of another apparatus of this invention suitable for carrying out the method of this invention.

FIG. 2 illustrates another fixing apparatus of this invention which is suitable for fixing toner to a receiver and provides for variable gloss levels. In this device the fixing member which contacts the toner on the receiver is a fuser roller rather than a belt as shown in FIG. 1. As shown in FIG. 2, the fixing apparatus 20 comprises a fixing system 29 and a post-treatment element 28. The fixing system 29 comprises a heated fuser roller 22, forming a nip with pressure roller 25 and another nip with pressure roller 26 and continuous conveyor means 24 trained partly about rollers 22, 25 and 26, and skive 27. Heated fuser roller 22 rotates in a counterclockwise direction while rollers 25 and 26 rotate in a clockwise direction, as viewed in FIG. 2. The surface of fuser roller 22 is heated by radiant heat from a heater 21 and is cooled by air provided by a blower 23. Receiver 7 bears unfixed toner 8. In operation, support 7 beating unfixed toner 8 is conveyed in the direction of the arrow on conveyor means 24 through the nip between rollers 22 and 25, around fuser roller 22 and continues through the nip between rollers 22 and 26. The toner is heated in the nip between rollers 22 and 25 and then cooled where blower 23 impinges air upon conveyor 24 which cools receiver 7, and the surface of roller 22. After being cooled by blower 23 and passing between rollers 22 and 26, receiver 7 bearing the fixed toner 8 is separated by skive 27 from roller 22. Upon separation, receiver 7 bearing the fixed toner 8 is transported by conveyor 24 to post-treatment element 28. The post-treatment element is shown as a radiant heater 28 which impinges heat upon the receiver 7 bearing the fixed toner 8 to adjust the gloss of the fixed toner 8. The temperature of the heater 28 can be adjusted to have a desirable effect on the gloss of the toner.

Figure 3:
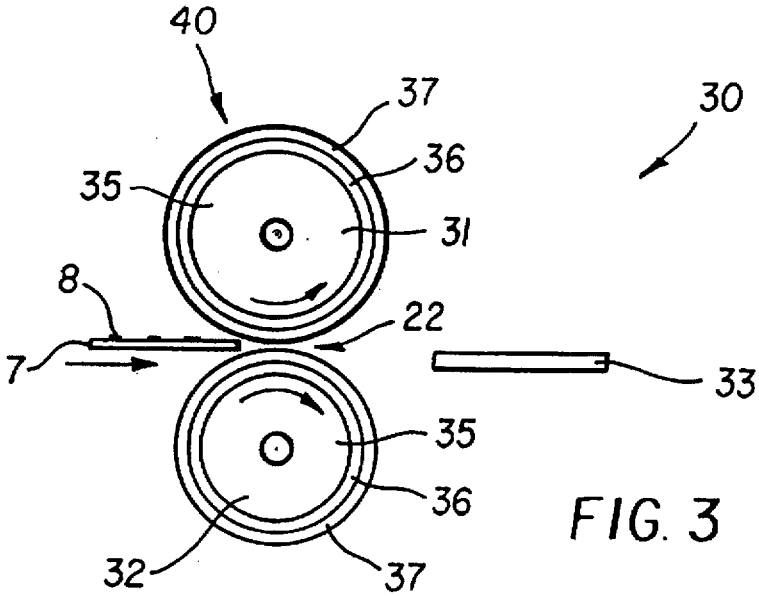
FIG. 3 is a schematic illustration of another apparatus of this invention suitable for carrying out the method of this invention.

FIG. 3 illustrates another apparatus 30 of this invention. Apparatus 30 comprises a fixing system 40 and a post-treatment element 33. The fixing system 40 comprises an internally heated fuser roller 31 and a pressure roller 32. Fuser roller 31 and pressure roller 32 are in pressurized contact forming a nip through which a receiver 7 bearing toner 8 passes. Fuser roller 31 and pressure roller 32 rotate in the direction of the arrows shown on the rollers, and receiver 7 moves through the nip in the direction of the arrow shown below the receiver 7 in FIG. 3. Passing the receiver 7 between rollers 31 and 32 fixes the toner 8 to the receiver 7. Then the receiver 7 beating the fixed toner 8 contacts the post-treatment element 33 shown as a heated plate. The temperature of the plate 33 can be adjusted according to the desired affect on the gloss of the fixed toner 8.

As shown in FIG. 3, the fuser roller 31 and the pressure roller 32 can be multi-layer rollers. The fuser roller 31 and the pressure roller 32 can comprise hard cylinders 35, made from, for example a conductive metal, and have one or more layers 36 and 37 of materials coated on them, such as silicone rubbers, fluorosilicone rubbers, fluoroelastomers, fluoropolymer resins, and/or release oils. Examples of rollers having coated layers of materials have been disclosed extensively in the prior art. However, presently it is preferred to have a fixing system having an uncoated roller or belt or a roller or belt having a coating of a hard material as either the fuser roller, pressure roller or fuser belt to produce fixed toner images having high gloss upon exiting the fixing system.

The heated roller, fuser roller, or pressure rollers can be internally or externally heated, by for example, an infra-red lamp, a heating coil, a radiant heater, or a contacting heated roller.

The figures show 3 different fusing apparatuses consisting of 3 different fixing systems in combination with 3 different post-treatment elements; however, any fixing system can be combined with any post-treatment element to form a fixing apparatus of this invention.

In addition to being able to adjust the post-treatment element prior to passing the fixed toner image by or through the post-treatment element, the fixing apparatus of this invention may have additional receiver handling hardware and software, which if no change in gloss is desired, would direct a fixed toner image around the post-treatment element to avoid adjusting the gloss of the fixed toner. Alternatively, the additional hardware and software could adjust the speed of the fixed toner image through the post-treatment element to control the affect of the post-treatment element on the fixed toner image.

Any receivers can be used in the method and apparatus of this invention, including various metal films, such as alumina and copper, metal-coated plastic films, organic polymeric films, and various types of paper. Polyethylene terephthalate is an excellent transparent polymeric receiver for forming transparencies. The most preferred receivers are paper and coated papers like those disclosed in U.S. Pat. No. 5,037,718.

Any toners can be used in the method and apparatus of this invention. Useful toner binder polymers include vinyl polymers, such as homopolymers and copolymers of styrene and condensation polymers such as polyesters and copolyesters. Particularly useful binder polymers are styrene polymers of from 40 to 100 percent by weight of styrene or styrene homologs and from 0 to 45 percent by weight of one or more lower alkyl acrylates or methacrylates. Fusible styrene-acrylic copolymers which are covalently lightly crosslinked with a divinyl compound such as divinylbenzene, as disclosed in U.S. Reissue Pat. No. 31,072, are particularly useful. Also especially useful are polyesters of aromatic dicarboxylic acids with one or more aliphatic diols, such as polyesters of isophthalic or terephthalic acid with diols such as ethylene glycol, cyclohexane dimethanol and bisphenols.

Another useful binder polymer composition comprises:

a) a copolymer of a vinyl aromatic monomer; a second monomer selected from the group consisting of i) conjugated diene monomers and ii) acrylate monomers selected from the group consisting of alkyl acrylate monomers and alkyl methacrylate monomers; and b) the acid form of an amine acid soap which is the salt of an alkyl sarcosine having an alkyl group which contains from about 10 to about 20 carbon atoms. Binder polymer compositions of this type having a third monomer which is a crosslinking agent are described in U.S. Provisional Application Ser. No. 60/001,632 entitled TONER COMPOSITIONS INCLUDING CROSSLINKED POLYMER BINDERS and filed in the names of Tyagi and Hadcock. Binders of this type not having a third monomer which is a crosslinking agent are made in accordance with the process described in U.S. Pat. No. 5,247,034 except that the copolymer includes a crosslinking agent.

Binder materials that are useful in the toner particles used in the method of this invention can be amorphous or semicrystalline polymers. The amorphous toner binder compositions have a Tg in the range of about 45° C. to 120° C., and often about 50° C. to 70° C. The useful semi-crystalline polymers have a Tm in the range of about 50° C. to 150° C. and more preferably between 60° C. and 125° C. The thermal characteristics, such as Tg and Tm, can be determined by any conventional method, e.g., differential scanning calorimetry (DSC).

Numerous colorant materials selected from dyestuffs or pigments can be employed in the toner particles used in the invention. Such materials serve to color the toner and/or render it more visible. Suitable toners can be prepared without the use of a colorant material where it is desired to have developed toner image of low optical densities. In those instances where it is desired to utilize a colorant, the colorants can, in principle be selected from virtually any of the compounds mentioned in the Colour Index Volumes 1 and 2, Second Edition. Suitable colorants include those typically employed in cyan, magenta and yellow colored toners. Such dyes and pigments are disclosed, for example, in U.S. Reissue Pat. No. 31,072 and in U.S. Pat. Nos. 4,160,644; 4,416,965; 4,414,152; and 2,229,513. One particularly useful colorant for toners to be used in black and white electrostatographic copying machines and printers is carbon black. The amount of colorant added may vary over a wide range, for example, from about 1 to 40 percent of the weight of binder polymer used in the toner particles. Mixtures of colorants can also be used.

Another component of the toner composition is a charge control agent. The term "charge control" refers to a propensity of a toner addendum to modify the triboelectric charging properties of the resulting toner. A very wide variety of charge control agents for positive charging toners are available. A large, but lesser number of charge control agents for negative charging toners is also available. Suitable charge control agents are disclosed, for example, in U.S. Pat. Nos. 3,893,935; 4,079,014; 4,323,634; 4,394,430 and British Patent Nos. 1,501,065; and 1,420,839. Charge control agents are generally employed in small quantities such as, from about 0.1 to about 5 weight percent based upon the weight of the toner. Additional charge control agents which are useful are described in U.S. Pat. Nos. 4,624,907; 4,814,250; 4,840,864; 4,834,920; 4,683,188 and 4,780,553. Mixtures of charge control agents can also be used.

Another component which can be present in the toner composition useful in this invention is an aliphatic amide or aliphatic acid. Suitable aliphatic amides and aliphatic acids are described, for example, in *Practical Organic Chemistry*, Arthur I. Vogel, 3rd Ed. John Wiley and Sons, Inc. N.Y. (1962); and *Thermoplastic Additives: Theory and Practice*, John T. Lutz Jr. Ed., Marcel Dekker, Inc, N.Y. (1989). Particularly useful aliphatic amide or aliphatic acids have from 8 to about 24 carbon atoms in the aliphatic chain. Examples of useful aliphatic amides and aliphatic acids include oleamide, eucamide, stearamide, behenamide, ehthylene bis(oleamide), ethylene bis(stearamide), ethylene bis (behenamide) and long chain acids including stearic, lauric, montanic, behenic, oleic and tall oil acids. Particularly preferred aliphatic amides and acids include stearamide, erucamide, ethylene bis-stearamide and stearic acid. The aliphatic amide or aliphatic acid is present in an amount from about 0.5 to 30 percent by weight, preferably from about 0.5 to 8 percent by weight. Mixtures of aliphatic amides and aliphatic acids can also be used. One useful stearamide is commercially available from Witco Corporation as KEMAMIDE S. A useful stearic acid is available from Witco Corporation as HYSTERENE 9718.

The toner can also contain other additives of the type used in previous toners, including magnetic pigments, leveling agents, surfactants, stabilizers, and the like. The total quantity of such additives can vary. A present preference is to employ not more than about 10 weight percent of such additives on a total toner powder composition weight basis.

Toners can optionally incorporate a small quantity of low surface energy material, as described in U.S. Pat. Nos. 4,517,272 and 4,758,491. Optionally the toner can contain a particulate additive on its surface such as the particulate additive disclosed in U.S. Pat. No. 5,192,637.

The toner compositions of the invention can be made with a process that is a modification of the evaporative limited coalescence process described in U.S. Pat. No. 4,883,060, the disclosure of which is hereby incorporated by reference. Alternatively, the toners can be commercially obtained from Eastman Kodak Co. and other toner manufacturers.

The toner can also be surface treated with small inorganic particles to impart powder flow, cleaning or improved transfer. Toners having transfer assisting addenda are commercially available from Ricoh, Cannon and other toner manufacturers or can be produced by the numerous methods disclosed in the prior art.

The toners applied to the receiver in this invention can be part of a developer which comprises a carrier and the toner. Carriers can be conductive, non-conductive, magnetic, or non-magnetic. Carders are particulate and can be glass beads; crystals of inorganic salts such as aluminum potassium chloride, ammonium chloride, or sodium nitrate; granules of zirconia, silicon, or silica; particles of hard resin such as poly(methyl methacrylate); and particles of elemental metal or alloy or oxide such as iron, steel, nickel, carborundum, cobalt, oxidized iron and mixtures of such materials. Examples of carriers are disclosed in U.S. Pat. Nos. 3,850,663 and 3,970,571. Especially useful in magnetic brush development procedures are iron particles such as porous iron, particles having oxidized surfaces, steel particles, and other "hard" and "soft" ferromagnetic materials such as gamma ferric oxides or ferrites of barium, strontium, lead, magnesium, or aluminum. Such carriers are disclosed in U.S. Pat. Nos. 4,042,518; 4,478,925; 4,764,445, 5,306,592 and 4,546,060.

Carrier particles can be uncoated or can be coated with a thin layer of a film-forming resin to establish the correct triboelectric relationship and charge level with the toner employed. Examples of suitable resins are the polymers described in U.S. Pat. Nos. 3,547,822; 3,632,512; 3,795,618 and 3,898,170 and Belgian Patent No. 797,132. One currently preferred carrier is a mixture of poly(vinlyidene fluoride) and poly(methyl methacrylate) as described for example in U.S. Pat. Nos. 4,590,140; 4,209,550; 4,297,427 and 4,937,166.

Another preferred carrier is strontium ferrite coated with fluorocarbon on a 0.5 percent weight/weight basis, and treated with an aqueous solution of 4 weight percent KOH and 4 weight percent of a 2 parts by weight to 1 parts by weight mixture of $Na_2S_2O_8$ and $Na_2S_2O_5$ as disclosed in U.S. Pat. No. 5,411,832, which is hereby incorporated herein by reference.

In a particular embodiment, the developer contains from about 1 to about 20 percent by weight of toner and from about 80 to about 99 percent by weight of carrier particles. Usually, carrier particles are larger than toner particles. Conventional carrier particles have a particle size of from about 5 to about 1200 micrometers and are preferably from 20 to 200 micrometers.

The developer can be made by simply mixing the described toner and the carrier in a suitable mixing device. The components are mixed until the developer achieves a maximum charge. Useful mixing devices include roll mills and other high energy mixing devices.

The term "particle size" used herein, or the term "size", or "sized" as employed herein in reference to the term "particles", means the median volume weighted diameter as measured by conventional diameter measuring devices, such as a Coulter Multisizer, sold by Coulter, Inc. of Hialeah, Fla. Median volume weighted diameter is the diameter of an equivalent weight spherical particle which represents the median for a sample.

The gloss levels for fixed toner images formed in this invention are typically at least 10 and often in the range of about 50 to 100. Such gloss levels are readily perceptible to the unaided eye; however, it is preferred that they are measured by a specular glossmeter at 20° using conventional techniques well known to those skilled in the art, for example, the method described in ASTM-523-67. A typical method utilizes a single reflectivity measurement. For this measurement the amount of light from a standard source which is specularly reflected in a defined path is measured. A suitable device for this purpose is a GLOSSGARD II 20° glossmeter (available commercially from Pacific Scientific, Inc., Silver Springs, Md.) which produces a reading, on a standardized scale, of a specularly reflected ray of light having angles of incidence and reflection of 20° to the normal. The standard scale of such meter has a range from 0 to 100, the instrument being normally calibrated or adjusted so that the upper limit corresponds to a surface that has substantially the same specular reflection of a true mirror. Reflectivity readings are indicated as gloss numbers.

The following examples are presented to further illustrate the method and apparatus of this invention.

EXAMPLES

A belt fixing system as illustrated in FIG. 1 was used to produce fixed toner images. The belt was a 120 micron thick electroformed nickel belt. The belt speed was 3.8 cm/sec (1.5 inches/sec). The nip pressure was 2.07 MPa (300 psi). The backup roller was a stainless steel roller having a 80 micron thick red rubber layer. The nip width was 0.63 cm (0.25 inches). The nip temperature was 110° C. (240° F.), and the release temperature of the fixed toner image from the belt was 99° C. (210° F.). Continuous toner density patches were fixed to coated paper in this belt fixing system and the gloss of the fixed toner images were measured and recorded. The coated paper was coated as described in U.S. Pat. No. 5,037,718.

The toners listed in Table 3 were used in Example 1, 2, 3 and 4. Absent from Table 3 is the charge agent in the toner compositions. Toners A, B, C, and D all contained the charge agent disclosed in U.S. Pat. No. 4,834,920 at 1% by weight of the toner. These toners were prepared by conventional melt compounding and pulverizing processes.

TABLE 3

Toner Compositions

| Toner | Binder | Tg (°C.) | <Mw> | Pigment |
|---|---|---|---|---|
| A | Styrene-Butyl Acrylate | 62 | 48,000 | 8% Pigment Blue 15:3 |
| B | Styrene-Butyl Acrylate | 58 | 330,000 | 6% Carbon Black |
| C | Polyester | 60 | 59,000 | 6% Carbon Black |
| D | Styrene | 60 | 7,000 | 12% Pigment Red 122 |

Example 1

Continuous toner density patches of Toner A were fixed to several sheets of paper in the belt fixing system described above, and then each sheet was placed on a plate for 15 seconds which was heated to different temperatures for each sheet and the gloss was measured for each sheet using a GLOSSGARD II 20° glossmeter described above. The results are in Table 4. This example shows that the gloss of the fixed toner can be changed by post-treatment using the application of heat to the fixed toner. The results in Table 4 indicate that higher post-treatment temperatures caused greater relaxation of the residual stress in a fixed toner, thereby causing the largest decrease in the gloss of the fixed toner.

TABLE 4

Results of Example 1

| Post-Treatment Temp (°C.) | Gloss ($G_{20}$) |
|---|---|
| No post-treatment | 102 |
| 50 | 99 |
| 75 | 96 |
| 100 | 88 |
| 125 | 83 |
| 150 | 75 |
| 175 | 53 |
| 200 | 16 |

Example 2

Toners A, B, C, and D of Table 3 were fixed and post-treated as described in Example 1 at the two temperatures indicated in Table 5. The gloss of the fixed toner and post-treated toner were measured as described above and listed in Table 5. This example indicates that it is possible to control the gloss of the fixed toner images having residual stress by the temperature of the post-treatment and the composition of the toner.

TABLE 5

Results of Example 2

| Toner | Initial Gloss | Gloss after 15 sec at 175° C. | Gloss after 15 sec at 200° C. |
|---|---|---|---|
| A | 102 | 53 | 16 |
| B | 50 | 23 | 0.4 |
| C | 43 | 20 | 2.2 |
| D | 98 | 86 | 69 |

Example 3

The same patches of Toner A were fixed to additional sheets of paper as described in Example 1 and then about 60 milliliters/meter$^2$ of plasticizer solutions consisting of the concentrations of di-2-ethylhexyl phthalate (DOP) in methanol indicated in Table 6 were applied to the fixed toner images by using a paint brash, and the gloss was measured as described above. The results are listed in Table 6. This example indicates that a plasticizer at different concentrations can be used to vary the amount of relaxation of a fixed toner, and thereby the final gloss of a toner image.

TABLE 6

Results of Example 3

| % Conc of DOP in Methanol | Gloss ($G_{20}$) |
|---|---|
| 0 | 102 |
| 0.2 | 88 |
| 0.5 | 63 |
| 1.0 | 38 |
| 2.0 | 24 |
| 3.0 | 13 |
| 4.0 | 10 |

Example 4

Example 3 was repeated except that the plasticizer solutions consisted of 0.5% by weight of the plasticizers listed in Table 4 in methanol. Gloss measurements as described above were taken before and after the application of about 60 ml/m$^2$ the plasticizer solutions to each fixed toner image. The plasticizer in the solutions and gloss measurements are listed in Table 7. The results in Table 7 show that different plasticizers applied to fixed toner images having residual stress cause differing amounts of relaxation of the residual stress of the fixed toner and, therefore, different final gloss levels.

TABLE 7

Results of Example 4

| Plasticizer Type | Initial Gloss | Gloss after treatment |
|---|---|---|
| Dibutyl Phthalate (DBT) | 102 | 23 |
| Di 2 ethylhexyl Phthalate (DOP) | 100 | 63 |
| Di tridecyl Phthalate (DTh) | 101 | 71 |
| Butyl Benzyl Phthalate (BBP) | 99 | 68 |
| Ethyl Acetate | 102 | 17 |
| Methylene Chloride (DCM) | 101 | 13 |
| Tricresyl Phosphate (TCP) | 98 | 47 |
| Dioctyl Adipate (DOA) | 102 | 76 |

All the examples above show that the gloss levels of fixed toner images having residual stress can be varied by the application of various post-treatment steps by a fixing apparatus of the invention.

The invention has been described with particular reference to preferred embodiments thereof but it will be understood that variations and modifications can be effected within the spirit and scope of the invention.

We claim:

1. A method of imparting various gloss levels to toner images, said method comprising the steps of:

fixing toner to a receiver in a fixing system, wherein said fixed toner possesses residual stress; and post-treating said fixed toner to at least partially relax said residual stress of said fixed toner.

2. The method of claim 1, wherein said post-treating step is accomplished by heating said fixed toner to raise the temperature of at least some of said fixed toner to a temperature at or above the glass transition temperature of said fixed toner.

3. The method of claim 2, wherein said heating step is accomplished by heating said fixed toner by a heated plate.

4. The method of claim 2, wherein said heating step is accomplished by passing said fixed toner between heated rollers.

5. The method of claim 2, wherein said heating step is accomplished by impinging heated air from a heated blower onto said fixed toner.

6. The method of claim 1, wherein said post-treating step is accomplished by applying plasticizer to said fixed toner.

7. The method of claim 6, wherein said applying plasticizer step is accomplished by spraying plasticizer onto said fixed toner.

8. The method of claim 6, wherein said plasticizer is selected from the groups consisting of di-2-ethylhexyl terephthalate, di-2-ethylhexyl phthalate (DOP), dibutyl phthalate (DBP), ditridecylphthalate (DTP), dioctyl terephthalate, butyl benzyl phthalate (BBP), dipropylene glycol dibenzoate, di-n-butyl azelate, di-n-hexyl azelate, di-2-ethylhexyl azelate, 2,2,4-trimethyl-1,3-pentanediol, diisodecyl glutarate, triethyl citrate, triaryl phosphate ester, tricresyl phosphate (TCP), diocty adipate (DOA), and alkyl diaryl phosphates.

9. The method of claim 1, wherein said fixing step is accomplished by the application of heat to said toner.

10. The method of claim 1, wherein said fixing step is accomplished by the application of pressure to said toner.

11. The method of claim 1, wherein said fixing step is accomplished by passing a toner-bearing receiver through a belt fuser system.

12. The method of claim 1, wherein said fixing step is accomplished by passing a toner-bearing receiver through a roller fuser system.

13. A fixing apparatus comprising:

a fixing system for fixing toner to a receiver, wherein said fixing system imposes residual stress into said fixed toner; and a post-treatment element which at least partially relaxes said residual stress of said fixed toner.

14. The fixing apparatus of claim 13, wherein said post-treatment element is a heated plate.

15. The fixing apparatus of claim 13, wherein said post-treatment element is a heated blower.

16. The fixing apparatus of claim 13, wherein said post-treatment element is a sprayer.

17. The fixing apparatus of claim 13, wherein said fixing system comprises a belt.

18. The fixing apparatus of claim 13, wherein said fixing system comprises a fuser roller and a pressure roller.

19. The fixing apparatus of claim 17, wherein the post-treatment element comprises a heated plate.

20. The fixing apparatus of claim 18, wherein the post-treatment element comprises a heated plate.

* * * * *